US005280808A

United States Patent [19]

Kvinge et al.

[11] Patent Number: 5,280,808

[45] Date of Patent: Jan. 25, 1994

[54] AIR VALVE ACTUATOR FOR RECIPROCABLE MACHINE

[75] Inventors: Daniel J. Kvinge, Shoreview; Marlin R. Melquist, Minneapolis; Steve P. Plager, Burnsville, all of

[73] Assignee: Graco Inc., Golden Valley, Minn.

[21] Appl. No.: 51,084

[22] Filed: Apr. 21, 1993

Related U.S. Application Data

[62] Division of Ser. No. 858,625, Mar. 27, 1992, Pat. No. 5,240,390.

[51] Int. Cl.[5] ..... F16K 11/074; F16K 31/56

[52] U.S. Cl. ..... 137/625.44; 251/75; 251/301

[58] Field of Search ..... 251/75, 301; 137/625.44, 104

[56] References Cited

U.S. PATENT DOCUMENTS

| | | | |
|---|---|---|---|
| 150,317 | 4/1874 | Goehring et al. . | |
| 215,026 | 5/1879 | Strater, Jr. . | |
| 374,530 | 12/1887 | Freeman . | |
| 405,939 | 6/1889 | Arnold . | |
| 1,114,008 | 10/1914 | Kofoed . | |
| 1,150,452 | 8/1915 | Reid . | |
| 1,623,028 | 3/1927 | Barett et al. . | |
| 2,124,735 | 7/1938 | Flint . | |
| 2,610,649 | 9/1952 | Brodhun | 251/75 X |
| 2,613,652 | 10/1952 | Ziegelmeyer . | |
| 2,678,029 | 5/1954 | Sprague et al. . | |
| 2,792,785 | 5/1957 | Hayden . | |
| 2,898,865 | 8/1959 | Gates . | |
| 2,951,382 | 9/1960 | Eklund . | |
| 2,977,040 | 3/1961 | Dulebohn et al. . | |
| 3,016,055 | 1/1962 | Oldenburg . | |
| 3,148,593 | 9/1964 | Toman . | |
| 3,167,083 | 1/1965 | Nickell . | |
| 3,448,756 | 6/1969 | Nordegren . | |
| 3,584,653 | 6/1971 | Kubo | 251/75 X |
| 3,700,359 | 10/1972 | Vanderjagt . | |
| 4,172,698 | 10/1979 | Hinz et al. . | |
| 4,354,806 | 10/1982 | McMillin et al. . | |
| 4,540,349 | 9/1985 | Du . | |
| 4,597,414 | 7/1986 | Johnson . | |
| 4,682,937 | 7/1987 | Credle, Jr. . | |

FOREIGN PATENT DOCUMENTS

| | | | |
|---|---|---|---|
| 15827 | 4/1906 | Norway | 137/625.44 |

*Primary Examiner*—Arnold Rosenthal

*Attorney, Agent, or Firm*—Palmatier, Sjoquist & Helget

[57] ABSTRACT

An air control valve for directing air flow in a double-acting reciprocable motor, where the valve has a first link which is pivotally connected at one end to the motor and mechanically coupled along its length to a reciprocable motor member; a second link pivotally connected to the same point as the first link, and having an over-center spring detent mechanism to position it in either of two pivot positions; both of the links having alignable transverse slots, with a compression coil spring engaged in both slots; and a slide valve member attached to the second link and pivotally movable therewith, to direct the air flow into either of the double-acting motor drive members, the air valve toggling to its second position near the end of the motor drive stroke to cause the motor to reciprocate in the other direction.

4 Claims, 3 Drawing Sheets

AIR VALVE ACTUATOR FOR RECIPROCABLE MACHINE

This is a division of U.S. patent application Ser. No. 07/858,625, filed Mar. 27, 1992 now U.S. Pat. No. 5,240,390 dated Aug. 31, 1993.

BACKGROUND OF THE INVENTION

The present invention is related to reciprocating machines, and particularly to an air valve actuator for reciprocating machines. The invention is particularly adaptable for use in connection with double-acting pneumatic reciprocating diaphragm pumps and the like, wherein a pair of spaced apart diaphragm pumping chambers are interconnected by a common shaft. The invention may also find use as a pilot valve in certain industrial applications, to divert a source of pressurized fluid to either of several paths as a result of sensing a relatively small range of mechanical movement.

Reciprocating machines, and in particular reciprocating motor and pump mechanisms, utilize a valving apparatus for controlling the stroke and the reversing mechanisms to permit the reciprocating action to occur. Such machines typically use a reversing valve which is actuated by the reciprocating mechanism near the end of a stroke, to switch the driving force acting against a piston and/or diaphragm from one direction to the opposite direction. In the case of double-acting pumps, the valve reversing mechanism is utilized to exhaust the driving fluid from one side of the pump, and to admit the driving fluid into the other side of the pump. In most cases double-acting, reciprocating pumps are constructed with the active pumping elements arranged along a common axis, and with a common shaft interconnecting both elements. The common shaft therefore reciprocates in accordance with the driving elements, which may be pistons or diaphragm elements. The reversing mechanism is conveniently coupled to the reciprocable common shaft to sense the stroke position, and to actuate a reversing valve at an appropriate stroke position, to divert the pressurized driving fluid from one side of the pump to the other.

The valve actuator which causes this fluid flow diversion must be capable of positive action over a wide range of reciprocating speeds. At extremely slow reciprocating speeds the valve actuator must not be susceptible to unstable or incomplete actuation, for this could cause the pump to "stall" and cease operating. At extremely high reciprocating speeds the valve actuator must be capable of actuation very quickly in order to enable the pump to deliver the necessary and required liquid flow rates. The slow speed requirements dictate a valve actuator which has positive, snap-action operation at the changeover point. The high-speed requirement dictates that the valve actuator have relatively low mass and inertia.

It is therefore a principal object of the present invention to provide an actuator for reciprocable machines which is capable of positive and reliable actuation over a wide range of operating speeds.

It is a further object of the present invention to provide a reciprocating machine valve actuator which has a positive action at a predetermined position of the reciprocating machine, regardless of speed of operation.

It is another object of the present invention to provide an air valve actuator for a double-acting diaphragm pump which is of simple and reliable construction.

It is yet a further object of the present invention to provide an air valve actuator for a double-acting reciprocable pump which operates as an inexpensive and simple reversing valve.

The foregoing and other objects will become apparent from the specification and claims herein, and with reference to the accompanying drawings. It should be understood, however, that the detailed description and the accompanying drawings, while indicating preferred embodiments of the present invention, are given by way of illustration only, since various changes and modifications within the spirit and scope of the invention will become apparent to those skilled in the art. Such changes and modifications should be considered to be within the scope of this invention.

SUMMARY OF THE INVENTION

A valve actuator for reciprocating machines, particularly pneumatically operated double-acting diaphragm and piston pumps, wherein the actuator mechanism is linked to the common shaft which interconnects the two pumping elements. The reciprocating motion of the shaft is coupled to an actuator link which is pivotally mounted about an axis normal to the drive shaft reciprocation direction. A detent link is also pivotally mounted about the same axis and is closely aligned with the actuator link, but otherwise unconnected to the drive shaft. The detent link carries a slide cup valve and is coupled to a spring detent mechanism which allows the detent link to be positioned in either of two predetermined positions about its pivot axis. The detent link and the actuator link have respective aligned slots therethrough, with a coil spring engaged in the slots and therefore urging the two links toward an aligned relationship. In a preferred embodiment of the invention, an actuating plug is placed inside the coil spring, the length of the actuating plug being less than the length of the slots, to thereby limit the maximum angular excursion about the pivot axis of one link with respect to the other. Because of the coupling mechanism, the actuator link swings about the pivot axis in coincidence with the drive shaft reciprocation, while the detent link is held in a fixed position by the spring detent mechanism; at a particular angular excursion of the actuator link the coil spring and/or spring plug overcomes the spring detent mechanism force and causes the detent link to follow the actuator link. The detent link rapidly moves to its second detent position, sliding the cup valve in coincidence, and the cup valve redirects the flow of pressurized fluid from one side of the pump to the other, while at the same time exhausting the previously pressurized side of the pump to an exhaust port.

BRIEF DESCRIPTION OF THE DRAWINGS

The invention will become more fully understood and apparent from the detailed description of the preferred embodiment provided herein, and with reference to the accompanying drawings, which are provided by way of illustration and not by way of limitation of the scope of the present invention.

DESCRIPTION OF THE PREFERRED EMBODIMENT

Figure 1:
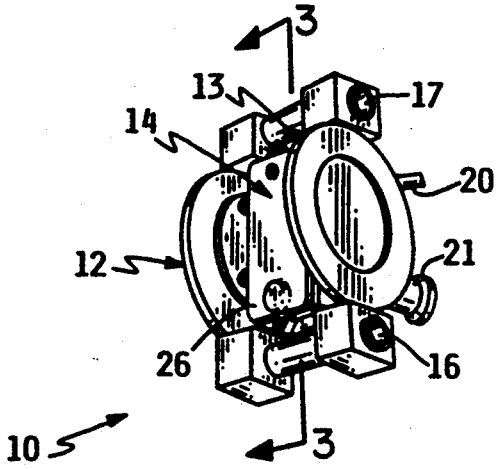
FIG. 1 shows an isometric view of a double-acting diaphragm pump incorporating the present invention.

Referring first to FIG. 1, there is shown an isometric view of a double-acting diaphragm pump 10. Pump 10 has a pair of aligned pumping chambers 12, 13, each of which contain a diaphragm, and wherein the diaphragms are interconnected by a common shaft. Intermediate pumping chambers 12, 13 is an actuator housing 14 which has a removable cover plate 26. Pumping chambers 12 and 13 have a pair of liquid delivery passages 16, 17 for receiving liquid and delivering liquid therefrom at an elevated pressure and flow delivery rate. Suitable check valves are utilized with chambers 12 and 13 to control the direction of flow into and out of the pumping chambers. In the embodiment shown in FIG. 2, passage 16 is an intake passage and passage 17 is a delivery passage. Actuator housing 14 has a pressurized air intake line 20 coupled thereto, and an air exhaust line 21 extending therefrom. The pressurized air provided by line 20 serves as the driving energy source for the operating features of pump 10.

Figure 2:
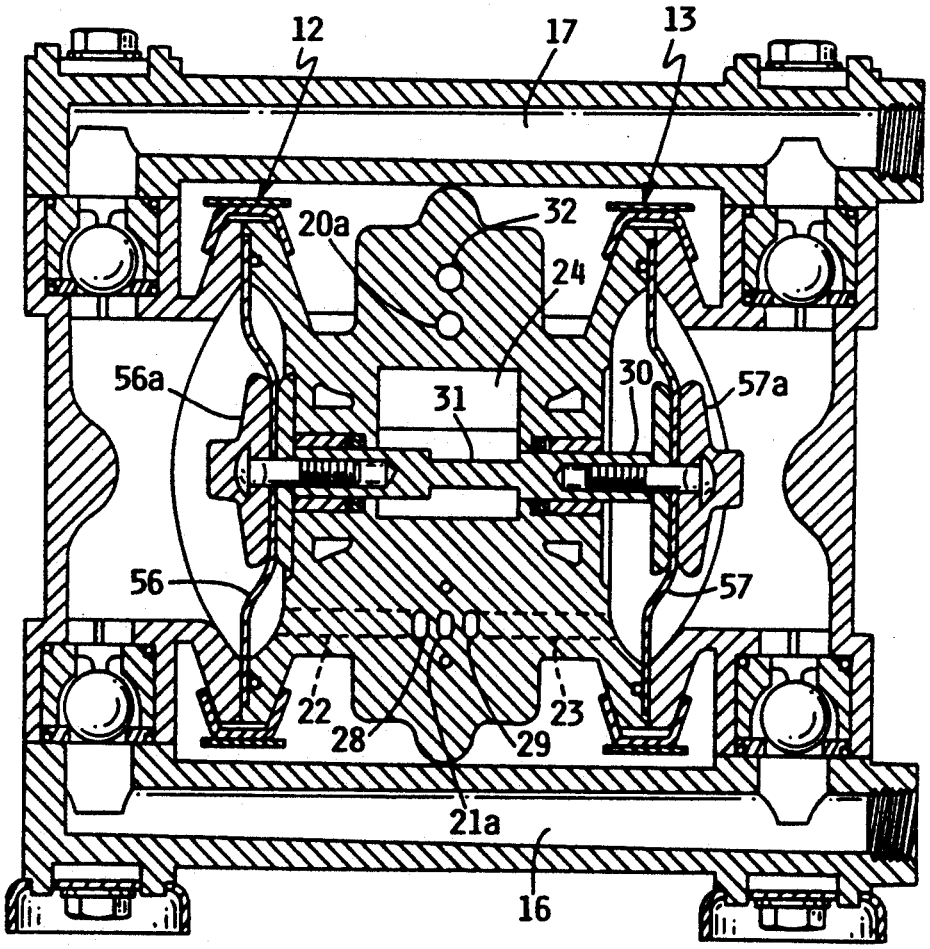
FIG. 2 shows a cross-section view taken along the lines 2—2 of FIG. 1.
Figure 3:
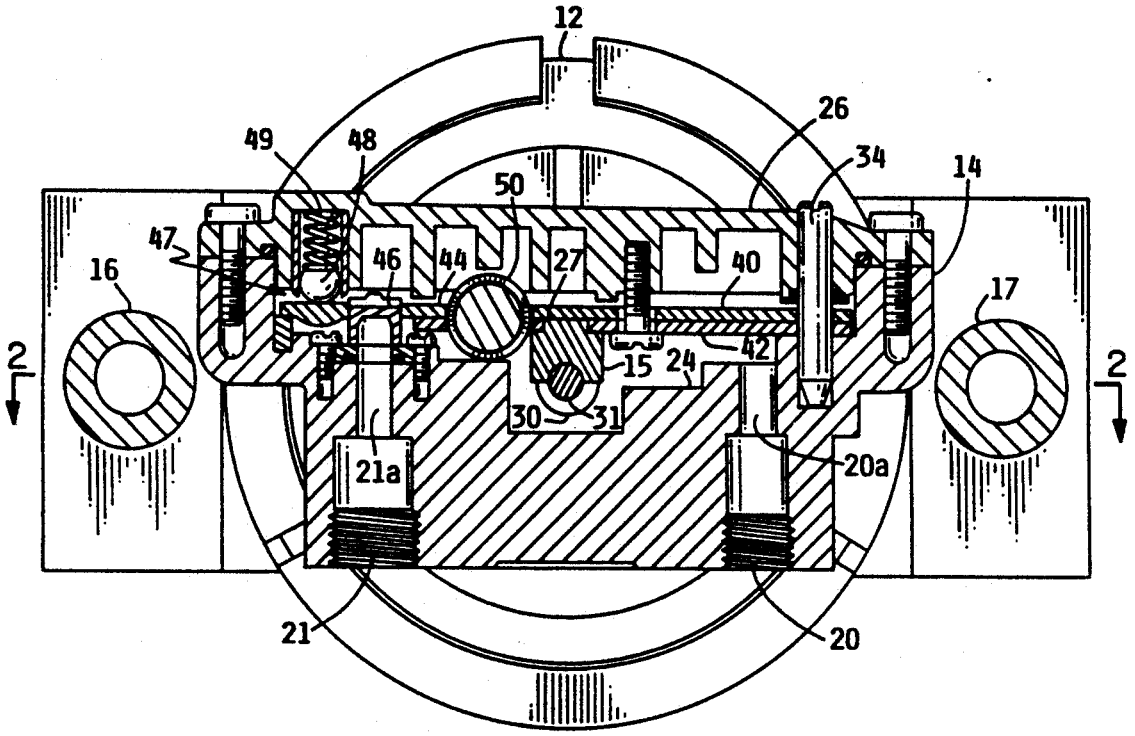
FIG. 3 shows a cross-sectional view of the pump and invention taken lines 3—3 of FIG. 1.

Referrinq next to FIG. 2, pump 10 is shown in cross-section view, taken along the lines 2—2 of FIG. 3. A cavity 24 is formed in actuator housing 14 to provide space for receiving the valve actuator mechanism, to be hereinafter described. A passage 20*a* is formed into cavity 24, and connects to pressurized air intake 20. An exhaust port 21*a* also opens into cavity 24, and connects to air exhaust 21. A passage 22 is coupled between pumping chamber 12 and cavity 24, opening into cavity 24 via a port 28. A passage 23 is coupled between pumping chamber 13 and cavity 24, opening into cavity 24 via port 29. A common shaft 30 interconnects between the respective diaphragms in pumping chambers 12 and 13, and passes through cavity 24. A center groove 31 in shaft 30 serves to assist in performing the driving linkage between shaft 30 and the valve actuator, to be hereinafter described. A pivot hole 32 is formed in cavity 24, for accepting the valve actuator pivot pin to be hereinafter described. A diaphragm 56 is clamped by a diaphragm holding mechanism 56*a* in chamber 12. Similarly, a diaphragm 57 is clamped by a diaphragm holding mechanism 57*a* in chamber 13.

FIG. 3 shows a view taken along the lines 3—3 of FIG. 1, with the valve actuator mechanism 40 in operational relationship. FIG. 3 also shows cover 26 secured into operable position on actuator housing 14. Air intake passage 20 and air exhaust passage 21 pass through housing 14 to open into the chamber created by cavity 24. Valve actuator mechanism 40 is pivotally attached to housing 14 by means of a pivot pin 34. Pivot pin 34 is preferably affixed to a detent link 44, whereas an actuator link 42 is freely movable about pivot pin 34. A coil spring 50 is seated within slots 35, 36 in detent link 44 and actuator link 42, for purposes to be hereinafter described (FIGS. 4A–4D). Detent link 44 has a cup valve 46 affixed against its underside surface, and has two detent depressions in its upper surface. A detent ball 48 is urged by a compression spring 49 into contact against the upper surface of detent link 44.

Figure 6:
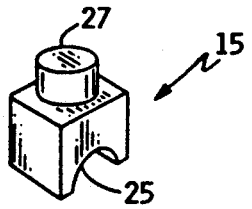
FIG. 6 shows one form of mechanical link between the actuator and drive shaft.

FIG. 6 shows a yoke 15 which is used as the mechanical linkage between the shaft groove 31 and actuator link 42. Yoke 15 has a curved lower surface 25 which is sized for engagement against shaft groove 31. The upper portion of yoke 15 forms a shoulder 27 which may be inserted through an opening 27*a* in actuator link 42. By the use of yoke 15, the reciprocable motion of shaft 30 is transferred to actuator link 42, thereby causing actuator link 42 to pivot in an oscillatory fashion about pin 34. Shoulder 27 does not engage detent link 44, but is engaged only through an opening in actuator link 42.

Figure 4D:
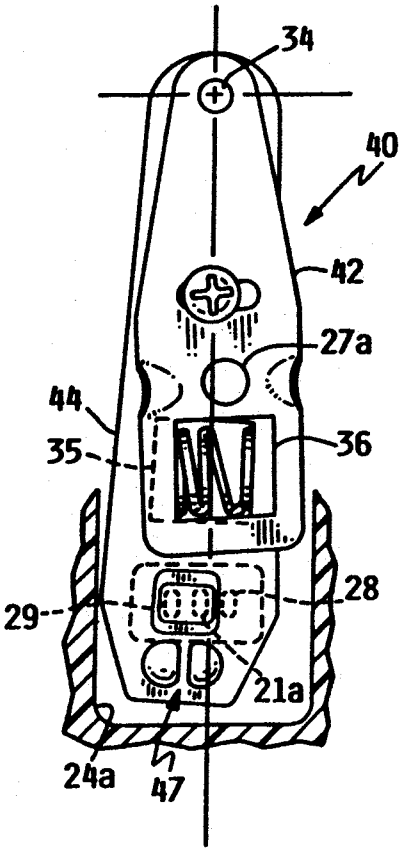
FIGS. 4A–4D show the present invention in four different operational positions.
Figure 4C:
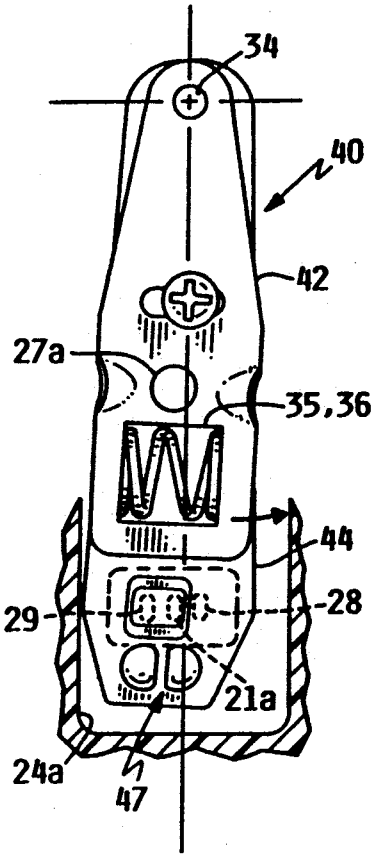
Figure 4B:
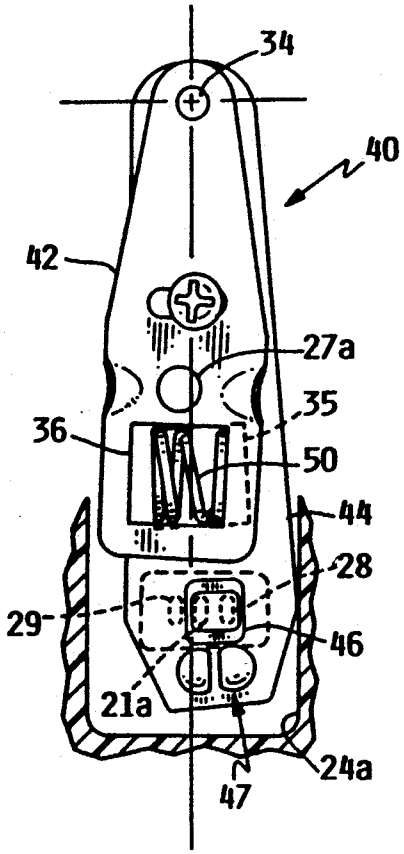
Figure 4A:
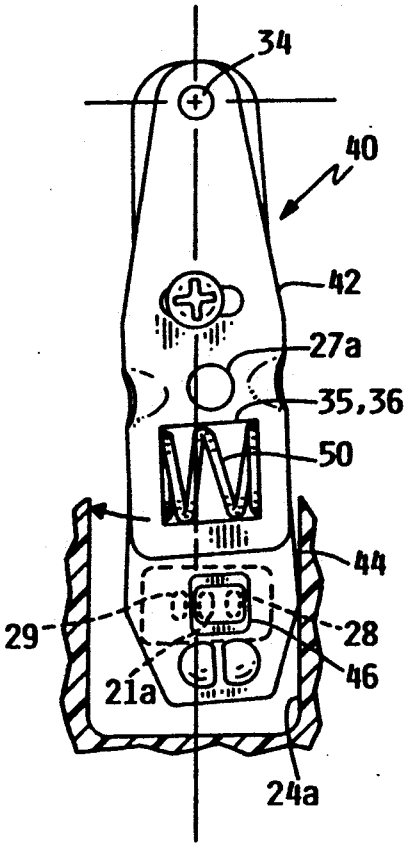

FIGS. 4A through 4D show bottom views of valve actuator 40 in each of four operational positions. FIG. 4A shows actuator link 42 and detent link 44 in alignment, wherein each are pivoted to one extreme pivot position within cavity 24. In this position, detent link 44 contacts the outside wall surface 24*a* of cavity 24. This position represents the rightmost position of the piston shaft 30, as viewed in FIGS. 4A–4D, and also corresponds to the changeover when piston shaft 30 begins moving leftward from its rightmost position, as indicated by the arrow in FIG. 4A. In the actuator link 42 position shown in FIG. 4A, cup valve 46 provides a flow communication path between passage 28 and exhaust port 21*a*. Passage 29 is exposed to the interior of the chamber formed by cavity 24, and is therefore exposed to the source of pressurized air which enters via port 20. The pressurized air flow into port 29 flows to pumping chamber 13, thereby forcing the diaphragm in chamber 13 outwardly. By contrast, the air in pumping chamber 12 passes through passage 28 to exhaust port 21, and is exhausted to the atmosphere; i.e., pumping chamber 12 becomes depressurized while pumping chamber 13 becomes pressurized.

FIG. 4B shows valve actuator 40 in a further position, wherein actuator link 42 has been pivoted leftwardly, viewed from the bottom, a predetermined amount, as a result of following the leftward movement of piston shaft 30. Detent link 44 remains in its rightmost position, under the influence of the spring detent mechanism 47, which tends to hold it in this position. As a result, coil spring 50 becomes compressed by the relative misalignment of the slots 35, 36 in actuator link 42 and detent link 44. The spring force developed by the compression of spring 50 is applied against detent link 44 in increasing amounts as actuator link 42 pivots leftwardly. It is to be noted that, in the position shown in FIG. 4B, port 29 remains exposed to the pressurized air within the chamber formed by cavity 24, and port 28 remains coupled in flow relationship to exhaust port 21.

FIG. 4C shows the respective positions of the actuator link and detent link after the spring force of coil spring 50 has increased sufficiently to cause detent link 44 to release from its detent position, and to move leftwardly into its second detent position, as shown. In this position, detent link 44 engages the interior wall 24*a* of cavity 24, and cup valve 46 provides a flow path from passage 29 to exhaust port 21. Passage 28 becomes exposed to the pressurized air within cavity 24, and conveys this pressurized air into chamber 12. This causes the diaphragm in chamber 12 to move outwardly, thereby causing shaft 30 to move rightwardly, as shown by the arrow in FIG. 4C. Actuator link 42 continues to move with shaft 30, and begins pivoting rightwardly in accordance with the movement of shaft 30.

FIG. 4D shows the positions of the actuator link and detent link after a predetermined rightward movement of shaft 30, and pivoting motion of actuator link 42. In this position, actuator link 42 has pivoted about pin 34 a predetermined angular amount. Detent link 44 remains in its leftmost position under the influence of the detent spring arrangement 47, but the compression force of coil spring 50 presents an increasing rightward force against detent link 44. Upon sufficient rightward movement of actuator link 42, the spring force of coil spring 50 is sufficiently large to overcome the spring detent force acting to hold detent link 44 in the position shown in FIG. 4D, and detent link 44 will then suddenly move rightwardly to its first detent position, as is shown in FIG. 4A. This completes the cycle of actuation provided by valve actuator 40 under all conditions of operation. It is important to note that detent link 44 will occupy either of two detent positions, depending upon the total spring forces acting against it. When the compression force of coil spring 50 exceeds the spring detent force acting upon detent link 44, the spring detent force is overcome and detent link 44 is rapidly forced into its other detent position.

Figure 5:
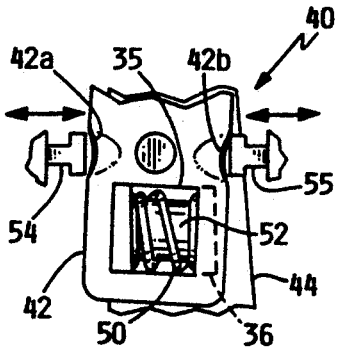
FIG. 5 shows an expanded view of a portion of an alternative form of the actuator.

FIG. 5 shows an alternate construction wherein a more positive and predetermined switchover may be provided with valve actuator 40. In this example a plug 52 is loosely inserted within coil spring 50, and is constrained therein by coil spring 50. Plug 52 is freely movable along the axis of coil spring 50 within slots 35, 36, when the actuator links 42, 44 are in alignment. As the actuator links 42, 44 become misaligned because of the pivoting motion of actuator link 42, the path of free movement of plug 52 gradually becomes reduced. At some degree of misalignment plug 52 becomes engaged between the respective side walls of slots 35, 36, and further pivotal motion of actuator link 42 forces a corresponding pivotal motion of detent link 44. This motion overcomes the detent spring force and causes detent link 44 to immediately snap into its other detent position. The advantage of the alternative construction of FIG. 5 is that it does provide a positive movement of detent link 44 at a predictable and predetermined pivotal position of actuator link 42. It removes any uncertainties in the balance of spring forces which act upon detent link 44, and in particular eliminates any uncertainties caused by spring force characteristics which may change over time and use. The alternative construction of FIG. 5 is therefore preferable for providing a valve actuator having precise action over an extended period of use.

FIG. 5 also shows an alternative with respect to the actuation mechanism of actuator link 42. This construction does not rely on the use of a yoke 15 to impart pivotal motion to actuator link 42 as previously described herein, but utilizes another form of actuation. It is particularly useful in some reciprocating mechanisms, wherein the reciprocable motion of a piston or diaphragm may be tracked by a movable pair of rods 54, 55. Rods 54, 55 may be aligned so as to move in correspondence with the reciprocation of a piston or other driving member, and also to come into contact with actuator link 42 during at least a portion of the reciprocation stroke. In this example, rods 54, 55 move laterally into contact with actuator link 42, thereby causing actuator link 42 to pivot about its pivot pin 34, to achieve the same relative pivotal motion as described earlier. Of course, in this construction the use of a yoke 15 or similar construction is unnecessary. However, it is preferable in this construction to form the actuator link 42 with partially raised lips 42*a*, 42*b* along its respective edges. This raised lip construction provides a more reliable contact surface for rods 54, 55.

In operation, the liquid inlet and outlet hoses are suitably connected to a source and destination of the liquid to be pumped, and pressurized air is coupled to pressurized air intake 20. The source of pressurized air is typically fed through a valve and regulator mechanism so that the degree of pressurization can be controlled. As soon as pressurized air is admitted into the actuator housing it immediately passes into one of the pumping chambers 12, 13, depending upon the initial position of valve actuator 40. This causes the diaphragm in the pressurized chamber to move outwardly, thereby moving the connecting shaft in the same direction and causing the valve actuator to operate correspondingly. At a predetermined shaft position the valve actuator toggles to redirect the flow of pressurized air to the other pumping chamber, and to relieve the first pumping chamber of its pressurized air. This causes the shaft to move in the opposite direction to continue the cycling of the pump. If the pressurized air is increased, the reciprocating action of the pump will correspondingly increase, and if the pressurized air is decreased the reciprocating action of the pump will correspondingly decrease.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An air control valve for directing air flow paths in a machine having a reciprocable member, comprising:
   a) a first linkage member pivotally connected proximate one of its ends to said machine and coupled to said reciprocable member, said first linkage member having a transverse slot therethrough;
   b) a second linkage member pivotally connected proximate one of its ends to said machine, said linkage member having spring detent means for urging said second linkage member into either of two predetermined detent positions; said second linkage member having a transverse slot therethrough which is alignable with the transverse slot in said first linkage member;
   c) a slide valve member attached to said second linkage member and movable therewith;
   d) at least two air passages in said machine, said air passages having ports exposed to contact by said slide valve member at predetermined positions thereof; and
   e) a compression spring engaged into both said transverse slots of said first and second linkage members; whereby the maximum spring force of said compression spring is sufficient to overcome said spring detent means.

2. The apparatus of claim 1, further comprising a slidable plug inside said compression spring and engaged in both of said transverse slots.

3. The apparatus of claim 1, further comprising a groove in said machine reciprocable member and a yoke fitted over said groove, said yoke having a raised shoulder; and wherein said first linkage member further comprises an opening fitted over said yoke raised shoulder.

4. The apparatus of claim 1, wherein said slide valve member further comprises a slidable cup valve, and said air passages further comprise three air passages having adjacent ports; whereby said cup valve may connect two of said three air passages into air flow coupling arrangement.

* * * * *